United States Patent [19]

Kammerer, Jr.

[11] 4,102,418

[45] Jul. 25, 1978

[54] BOREHOLE DRILLING APPARATUS

[75] Inventor: Archer W. Kammerer, Jr., Columbus, N.C.

[73] Assignee: Bakerdrill Inc., San Angelo, Tex.

[21] Appl. No.: 761,627

[22] Filed: Jan. 24, 1977

[51] Int. Cl.[2] ..... E21B 17/00

[52] U.S. Cl. ..... 175/324; 175/215

[58] Field of Search ..... 175/38, 65, 72, 100, 175/324, 325, 337, 393, 215

[56] References Cited

U.S. PATENT DOCUMENTS

| | | | |
|---|---|---|---|
| 3,208,539 | 9/1965 | Henderson | 175/215 |
| 3,439,757 | 4/1969 | Elenburg | 175/339 X |
| 3,503,461 | 3/1970 | Shirley | 175/325 |
| 3,596,720 | 8/1971 | Elenburg | 175/215 X |
| 3,638,742 | 2/1972 | Wallace | 175/325 |
| 3,667,555 | 6/1972 | Elenburg | 175/215 X |
| 3,991,834 | 11/1976 | Curington | 175/215 X |

*Primary Examiner*—Ernest R. Purser
*Assistant Examiner*—Richard E. Favreau
*Attorney, Agent, or Firm*—Neal J. Mosely; Bernard Kriegel

[57] ABSTRACT

A borehole drilling apparatus adapted for connection to a drilling string, wherein the cuttings pass through the center of the drill bit and are adapted for conveyance to the surface through a central pipe of the drilling string, a labyrinth seal being located between the outer perimeter of the apparatus and the wall of the borehole to provide an annular region of relatively immobile or stagnant fluid around the apparatus to forestall movement of fluid upwardly and downwardly past the labyrinth seal, part of the drilling fluid being conducted in a downward direction below the seal to force cuttings toward and through the center of the drill bit for upward conveyance through the central pipe, another portion of the drilling fluid being discharged above the seal for upward conveyance through the annulus between the drilling string and wall of the borehole to the top of the latter, whereby any formation material which may drop into the borehole annulus will be forced upwardly through such annulus to the top of the hole, the formation cuttings passing toward the bit center remaining uncontaminated.

11 Claims, 3 Drawing Figures

BOREHOLE DRILLING APPARATUS

Figure 1A:
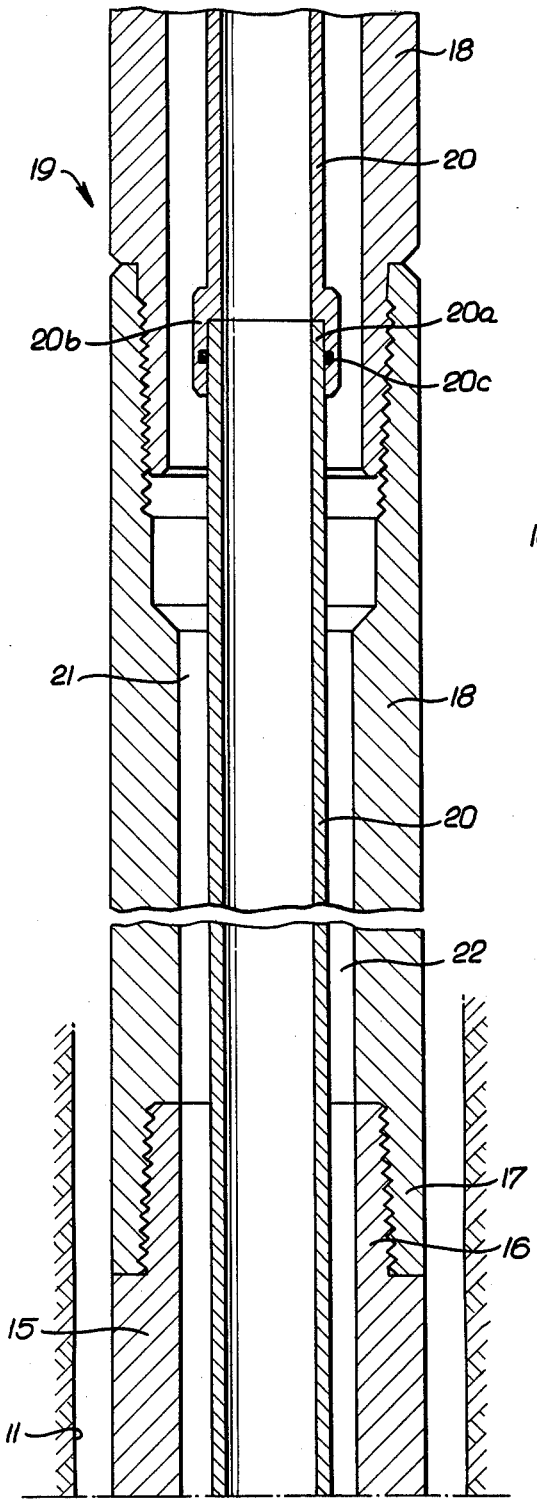

The present invention relates to apparatus for borehole drilling, and more particularly to apparatus in which the cuttings are conveyed to the top of the borehole free from contamination by other formation material.

In the U.S. Pat. No. 3,638,742, a seal apparatus is disclosed for sealing off a borehole during drilling so as to permit drilling fluid circulation without introducing such fluid into the annulus between the wall of the well bore and the drill pipe. For this purpose there is provided a flexible ring, such as an air inflated vehicle tire, which is adapted to engage the wall of the borehole to form a seal therewith above the drill bit to prevent circulating fluid from passing into the annulus above such seal. However, with apparatus of the type disclosed in the above patent, as the drill bit rotates and drills downwardly, the vehicle tire slides frictionally against and along the wall of the borehole, effecting damage to the tire and shortening its life. Additionally, formation materials above the tire can dislodge from the wall of the borehole into the annulus around the drill pipe and drop toward the tire, forming a barrier to subsequent elevation of the drilling apparatus in the borehole.

It is, accordingly, an object of the invention to provide drilling apparatus having an improved sealing device for preventing cuttings from passing upwardly around the apparatus into the drilling string annulus thereabove, and which effects conveyance of formation material away from the drilling region through the drilling string annulus to the top of the borehole.

Another object of the invention is to provide drilling apparatus embodying a drill bit and an improved seal device that does not substantially engage the borehole wall, minimizing frictional resistance to downward feeding of the apparatus in the borehole during drilling, and which prevents the formation cuttings from moving upwardly past the seal device into the drilling string annulus thereabove. More specifically, the seal device is slightly smaller in diameter than the diameter of the borehole being drilled, drilling fluid being discharged into the hole above and below the device to provide a substantially immovable fluid zone around the seal device that prevents upward and downward flow of fluid along the exterior of the seal device. Accordingly, formation material that might otherwise drop from above into the drilling string annulus is carried by the fluid discharged above the device upwardly out of the borehole, while fluid discharged below the device carries all cuttings toward the center of the bit for upward conveyance therethrough and through the drilling string to the top of the borehole.

It is a further object of the invention to provide a sealing device for use in conjunction with a bit for drilling a borehole in a formation, the device being capable of discharging drilling fluid into the borehole both above and below the device, to provide a stagnant fluid zone around the device, the device being much simpler than prior devices, more economical to manufacture, and possessing a longer useful life.

In accordance with an embodiment of the invention, there is provided a drilling apparatus including a labyrinth type of seal device slightly less in diameter than the diameter of the borehole being drilled, which is rotatable with a bit for drilling the borehole, downwardly and upwardly extending fluid passages being provided for discharging drilling fluid into the annular space around the apparatus and drill pipe string, the passages discharging drilling fluid, such as compressed air, downwardly below the labyrinth seal to carry formation cuttings to and through the center of the drill bit for conveyance through the drill pipe string to the top of the borehole, and upwardly into the annulus around the drill pipe string and above the labyrinth seal. The upwardly discharging drilling fluid forces formation debris, which drops or tends to drop into the borehole, upwardly through the annulus around the drill pipe string out of the borehole.

The pressure of the fluid discharging into the annulus above the labyrinth seal and the pressure of the fluid discharging into the annulus below the seal are substantially the same, whereby the labyrinth seal adjacent the wall of the borehole, and positioned between the oppositely directed outlets of the fluid passages, functions as a stagnation collar preventing drilling fluid and debris from flowing past the seal in upward and downward directions.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Figure 1B:
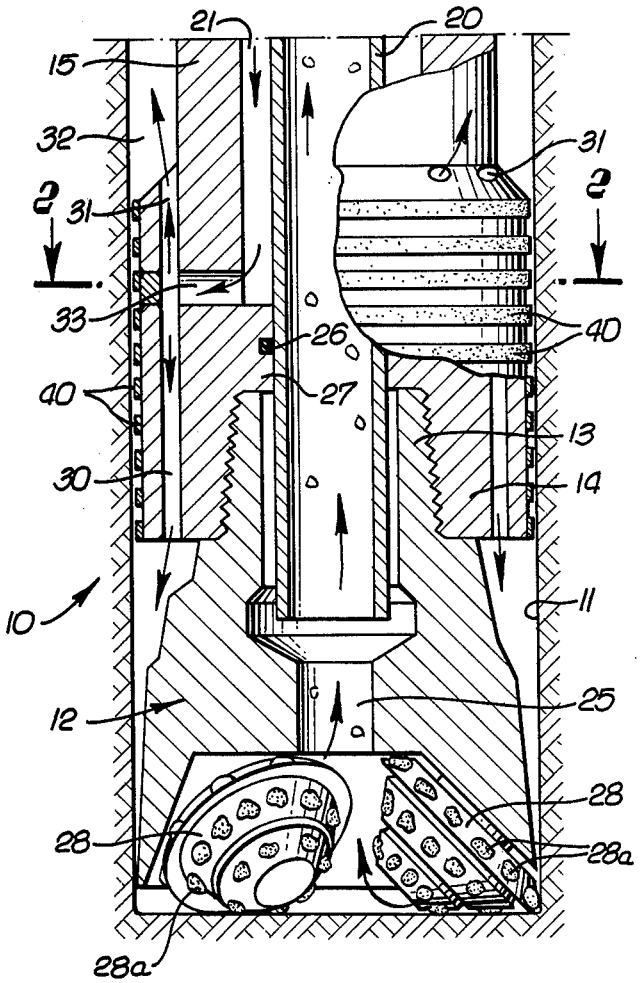
Figure 2:
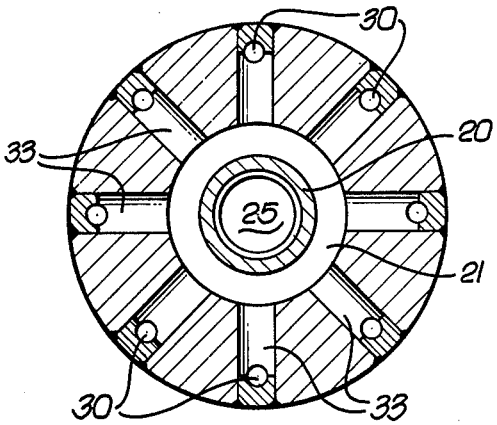

Referring to the drawings:

FIGS. 1*a* and 1*b* together constitute a longitudinal section through a drilling apparatus embodying the invention, with a portion of FIG. 1*b* being disclosed in side elevation, FIG. 1*b* being a lower continuation of FIG. 1*a*; and FIG. 2 is a cross-section taken along the line 2—2 on FIG. 1*b*.

As disclosed in the drawings, a drill bit apparatus 10 is disclosed for drilling a borehole 11 to a desired diameter, the apparatus including a known type of drill bit 12 having an upper pin 13 threadedly secured into a companion lower threaded box 14 of a sub or body member 15. The upper end of the body member has a threaded pin 16 threadedly secured into a companion box 17 of outer sections 18 of a dual drill pipe string 19 extending to the top of the borehole. This dual string includes an inner string of drill pipe sections 20 spaced from the inner wall of the outer drill pipe sections 18 to form an annular passage 21 therebetween. The outer drill pipe sections 18 are threadedly secured to one another, whereas the inner drill pipe sections 20 are suitably held coaxially in the outer sections by suitable and known arrangements, such as disclosed in U.S. Pat. No. 3,970,335. As specifically shown, leakage of fluid from the inner drill pipe string sections is prevented by piloting the upper end 20*a* of each section within a companion box 20*b* in the lower end of the adjacent inner section, there being a suitable seal 20*c* mounted in the box and engaging the periphery of the upper end of the inner section to prevent leakage therefrom. The lowermost inner drill pipe section 20 extends through the body member 15, and may terminate within the upper portion of the drill bit 12, which has a central opening 25 therein through which cuttings can pass in an upward direction through the bit and into the inner drill pipe string 20 for conveyance to the top of the borehole. Fluid is prevented from passing upwardly around the lower portion of the lowermost drill pipe section 20 by a seal 26, such as an O-ring seal, mounted in an inwardly directed flange 27 of a body member, and sealing against the periphery of the lowermost inner section 20.

The drill bit 12 is of any suitable type. As shown, a rotary drill bit is disclosed having suitable cutters 28, such as roller type cutters, which engage the bottom of the borehole 11 to perform their drilling action as a result of rotation of the inner and outer drill pipe strings 19 and drill bit, with suitable drilling weight being imposed upon the drill bit and its cutters, to obtain penetration of the cutting elements **28*a* into the bottom of the borehole. As specifically described hereinbelow, drilling fluid, such as drilling mud or compressed air, is pumped downwardly through the annulus 21 between the inner and outer pipe strings 20, 18 which will discharge from the body member 15, part of such fluid being directed downwardly to sweep the cuttings toward the center of the bit and upwardly through the central passage 25 for continued upward passage through the inner pipe string 20 to the top of the borehole. As specifically shown, a plurality of circumferentially spaced longitudinal passages, jets or ports 30, 31, are provided, the jets 30 discharging fluid from the body member in a downward direction, the jets 31 discharging fluid in an upward direction into the annular space 32 between the wall of the borehole 11 and the body member 15**, as well as between the wall of the borehole and the dual pipe string extending to the top of the borehole.

The fluid pumped down through the annular space 21 between the inner and outer pipe strings flows through the radial ports 33 in the body member, communicating with the longitudinal passages 30, 31 so that fluid is being discharged simultaneously in a downward direction around the drill bit 12 to engage the bottom of the borehole and sweep the cuttings inwardly and up through the bit passage 25 and the passage through the inner pipe string 20 to the top of the borehole. At the same time, the drilling fluid is discharging in an upward direction from the longitudinal passages 31 to be assured that any formation and other materials that might be present in the drill pipe - borehole annulus 32 are carried through such annulus to the top of the borehole, thereby insuring that undesired materials do not settle toward the body member 15, and thereby possibly tend to stick the drilling string in the borehole, to restrict its rotation at the desired drilling speed, as well as resist its elevation in the well bore when the drilling string and apparatus 10 are being withdrawn from the borehole.

To insure that the cuttings are all swept toward the central portion of the bit, for upward movement through its passage 25 and into the inner drill pipe string 20, the longitudinal passages 30, 31 are made of such size that the fluid pressure in the annulus above the body member 15 will be substantially the same as the pressure in the borehole immediately below the body member. This provides a stagnant body of drilling fluid along the exterior of the body member 15 which can function as the fluid seal or barrier against upward flow of the drilling fluid and cuttings around the body member, and downward flow of the fluid in the annulus 32 between the wall of the well bore and the outer drill string member 18 along the exterior of the body member 15. The body member 15 may have an external diameter substantially equal to and slightly less than the diameter of the borehole 11 being drilled leaving little, if any, space around the body member 15 through which external fluid below the body member and external fluid above the longitudinal passages and around the body member can pass.

To reduce the ability of the external fluid to move in either direction around the body member, a labyrinth seal is provided. This seal consists of rings or bands 40 of hardfaced material welded or otherwise suitably secured to the body, or they may consist of hardfacing material, such as tungsten carbide, welded around the body, with such bands of material being in spaced relation to each other. Any fluid that might tend to migrate upwardly or downwardly along the exterior of the body member will have its flow greatly impeded by virtue of the tortuous path it will be required to pursue in attempting to move through the labyrinth seal, which is provided by the spaced bands or rings of hardfaced material.

The cuttings passing upwardly into and through the inner drill pipe string 20 represents the cuttings just drilled by the cutters 28 at the bottom of the well bore and are not contaminated by material that might be present in the annular space 32 surrounding the dual drill pipe string. The labyrinth seal member prevents contamination of the cuttings by equalizing the pressure at the lower and upper dischrge ends of the longitudinal passages 30, 31, providing the dead fluid space along and within the seal member 15, 40. The labyrinth seal body member will have a long life, since its bands do not bear with a high degree of friction against the wall of the borehole 11, either as a result of rotation of the body member 15 or as a result of its longitudinal movement. The apparatus is relatively simple and economical to manufacture, as compared with prior devices that have been presented for the drilling of the borehole, insuring that the cuttings will pass upwardly through the central portion 25 of the bit and into the inner pipe 20 of the dual pipe string 19.

I claim:

1. Apparatus for use in drilling a borehole in an earth formation by means of a drill bit and a dual drilling string having an outer annular passage through which drilling fluid is forced downwardly for discharge into the region being drilled by the bit and an inner passage through which the cuttings are conveyed upwardly to the top of the borehole; comprising a body member operatively connectable at one end to the drill bit and at the other end to the drilling string, said body member having an outside diameter substantially the same as the diameter of the borehole to be drilled, said body having passageways for conducting fluid from said annular passage simultaneously into the borehole below said body member and above and outside the drill bit and into the borehole above said body member to create a zone of substantially static fluid along the outside of said body member, said body member having longitudinally spaced peripheral ring portions intermediate the outlet ends of said passageways to provide a labyrinth seal around said body member.

2. Apparatus as defined in claim 1; said body member having an opening into which said inner passage can extend in leak-proof relation to said body member.

3. Apparatus as defined in claim 1; said passageways comprising circumferentially spaced longitudinally extending passageways adjacent to the outer surface of said body member having outlet ends opening above and below said body member, and passageways interconnecting said first named passageways and said annular passage.

4. Apparatus as defined in claim 3; said longitudinally extending passageways being so proportioned that the pressure of the fluid discharged therefrom below said body member and the pressure of the fluid discharged therefrom above said body member are substantially the same.

5. Apparatus as defined in claim 3; said longitudinally extending passageways being so proportioned that the pressure of the fluid discharged therefrom below said body member and the pressure of the fluid discharged therefrom above said body member are substantially the same, said body member having an opening into which the second passage can extend in leak-proof relation to said body member, said body member having a lower threaded connection for securing said body member to the drill bit, said body member having an upper threaded connection for securing said body member to the drilling string.

6. Apparatus for drilling a borehole in an earth formation; comprising a dual drilling string including inner and outer concentric pipe sections providing an annular passage therebetween, a body member connected to said drilling string, a drill bit connected to said body member and having a central passage opening directly into the open end of said inner pipe section to conduct cuttings produced by the bit upwardly through said drill bit and through said inner pipe section, said body member having passageways for conducting fluid from said annular passage simultaneously into the borehole below said body member and outside and above said drill bit and into the borehole above said body member to create a zone of substantial static fluid along the outside of said body member, said body member having longitudinally spaced peripheral ring portions intermediate the outlet ends of said passageways to provide a labyrinth seal around said body member.

7. Apparatus as defined in claim 6; and seal means between said body member and said inner pipe section.

8. Apparatus as defined in claim 6; said drill bit being a rotary drill bit.

9. Apparatus as defined in claim 6; said passageways comprising circumferentially spaced longitudinally extending pssageways adjacent to the outer surface of said body member having outlet ends opening above and below said body member, and passageways interconnecting said first named passageways and said outer pipe section.

10. Apparatus as defined in claim 9; said longitudinally extending passageways being so proportioned that the pressure of the fluid discharged therefrom below said body member and the pressure of the fluid discharged therefrom above said body member are substantially the same.

11. Apparatus as defined in claim 9; said longitudinally extending passages being so proportioned that the pressure of the fluid discharged therefrom below said body member and the pressure of the fluid discharged therefrom above said body member are substantially the same, and seal means between said body member and said inner pipe section, said drill bit being a rotary drill bit.

* * * * *